US005372331A

United States Patent [19]

Miller et al.

[11] Patent Number: 5,372,331

[45] Date of Patent: Dec. 13, 1994

[54] EXPANSIBLE SHAFT FOR ROLL CORE

[75] Inventors: William R. Miller, Portland, Oreg.; Timothy J. Becker, Vancouver, Wash.

[73] Assignee: Tidland Corporation, Camas, Wash.

[21] Appl. No.: 78,762

[22] Filed: Jun. 15, 1993

[51] Int. Cl.[5] ..... B65H 75/24

[52] U.S. Cl. ..... 242/571.2; 242/571.1

[58] Field of Search ..... 242/72 R, 72 B, 571.1, 242/571.2; 279/2.07, 2.08

[56] References Cited

U.S. PATENT DOCUMENTS

| | | | |
|---|---|---|---|
| 2,656,990 | 10/1953 | Radtke | 242/72 |
| 2,720,735 | 10/1955 | Reuhl et al. | 51/227 |
| 2,801,694 | 8/1957 | Schneider et al. | 242/72 B |
| 2,891,798 | 6/1959 | Smith | 279/2 |
| 3,214,109 | 10/1965 | Gadde et al. | 242/72 B |
| 3,223,341 | 12/1965 | Gadde | 242/72 B |
| 3,253,323 | 5/1966 | Saueressig | 29/113 |
| 3,394,902 | 7/1968 | Hise et al. | 242/72 |
| 3,414,210 | 12/1968 | Gaudin | 242/72 |
| 3,425,642 | 2/1969 | May | 242/72 |
| 3,592,405 | 7/1971 | Young | 242/72 B |
| 3,825,167 | 7/1974 | Komorek et al. | 279/2 |
| 3,834,257 | 9/1974 | Ganser | 82/44 |
| 3,904,143 | 9/1975 | Kullander | 242/72 B |
| 3,904,144 | 9/1975 | Gattrugeri | 242/72 |
| 3,937,412 | 2/1976 | Damour | 242/72 |
| 4,026,491 | 5/1977 | Bostroem | 242/72 |
| 4,124,173 | 11/1978 | Damour | 242/72 |
| 4,147,312 | 4/1979 | Secor et al. | 242/72 R |
| 4,771,963 | 9/1988 | Gattrugeri | 242/72 B |
| 4,828,198 | 5/1989 | Kann et al. | 242/72 |

FOREIGN PATENT DOCUMENTS

| | | | |
|---|---|---|---|
| 2132823 | 1/1972 | Germany | 242/72 B |
| 1170649 | 11/1967 | United Kingdom . | |

*Primary Examiner*—Daniel P. Stodola
*Assistant Examiner*—John P. Darling
*Attorney, Agent, or Firm*—Chernoff, Vilhauer, McClung & Stenzel

[57] ABSTRACT

An elongate expansible shaft for a roll core has a peripheral surface defining multiple separate elongate slots helically intertwined and oriented at a pitch angle no greater than about 30° measured from a longitudinal axis. Each slot is T-shaped in cross section and contains a respective separate, elongate, resilient T-shaped bladder pneumatically expandable into frictional engagement with the core. The bladder has a unitary construction with hinge portions for minimizing the loss of force due to expansion of the bladder. An air inlet fitting is inserted in one end of each bladder and is independently connected to a respective separate valve for preventing the escape of air from the bladder irrespective of the air pressure in any other bladder.

6 Claims, 4 Drawing Sheets

EXPANSIBLE SHAFT FOR ROLL CORE

BACKGROUND OF THE INVENTION

This invention relates to a pneumatically expansible shaft assembly for insertion into a paper roll core or other sheet roll core.

During manufacture of paper or other sheet products, the sheet material is typically wound onto, or unwound from, a tubular core supported by a diametrically expansible shaft insertable into the core and expanded to grip the core frictionally. Most conventional expansible roll core shafts employ a large number of relatively small, separate core-engaging elements expansible by a common internal air-expandable bladder. However, an increasingly popular type of shaft has straight, parallel slots cut longitudinally in its periphery in which are mounted respective straight, separate, air-expandable, resilient bladders overlain by respective straight core-contacting elements which extend throughout the length of the shaft. This type of shaft is exemplified by U.S. Pat. No. 3,904,144.

In this latter type of shaft, frictional torque transmission between the shaft and the core for driving or braking is dependent upon the total contact area between the core and the straight core-contacting elements on the shaft, as well as the air pressure. However, merely increasing the total number of straight, longitudinal slots in the shaft periphery to increase the number, and thus the area, of the core-contacting elements causes a significant decrease in the beam strength of the shaft. Accordingly, the amount of contact area obtainable with straight longitudinal slots and core-contacting elements is significantly restricted.

Also, the elastomeric nature of the separate expandable bladders in the slots subtracts from the contact force transferred from the air pressure within the bladders, due to resilient resistance as the bladders expand, further restricting the frictional torque transmission between the shaft and the core.

It has been found advantageous in the past to provide independent valves for the separate bladders to prevent each bladder from losing pressure as a result of a leak in another bladder, so that the core remains frictionally engaged with the shaft despite such leak, as shown in U.S. Pat. No. 3,904,144. However, the loss of pressure in a single straight, longitudinally oriented bladder can change the axial relationship between the shaft and core which can adversely affect certain converting operations. Alternatively, using separate, independently valved annular bladders, as shown in FIG. 7 of U.S. Pat. No. 3,904,144, causes an extremely high reduction in the beam strength of the shaft.

Another problem caused by straight core-contacting elements and their associated bladders is the deformation of a circular core prior to winding, which causes non-circular roll formation in the early stages of winding with resultant dynamic imbalance.

Helical slots have been used in expansible core shafts in the past, as exemplified by British patent publication No. 1,170,649, and U.S. Pat. Nos. 2,720,735, 3,825,167, 3,834,257, 3,937,412 and 4,124,173. Each of these discloses a helical slot containing a pneumatically expandable elastic pressure hose. However, in each case the helical slot contains only a single continuous hose which will lose pressure entirely if a leak develops in any portion of it, thereby releasing the frictional engagement between the shaft and core. Moreover, each slot exhibits a high pitch angle of 45° or more relative to the longitudinal axis of the shaft, meaning that a great deal of beam strength is lost by the provision of the helical slot. Also, the resilient resistance of the hoses as they expand can subtract significantly from the contact force transferred from the air pressure within the hoses.

What is needed, therefore, is an expansible shaft having separate bladders but which maintains substantially the same axial relationship between the shaft and core even though a leak may develop in one bladder, and which provides an increased contact area between the core-contacting elements and the core without significantly decreasing shaft beam strength. There is also a need for a bladder design which minimizes the loss of contact force due to bladder expansion.

SUMMARY OF THE INVENTION

The present invention satisfies the foregoing needs by providing an expansible shaft, insertable in a roll core, that has in its peripheral surface multiple, separate, elongate, helical slots intertwined with each other, each containing a respective separate elongate resilient bladder expandable under fluid pressure to create frictional engagement with the core. Such inter-twined helical slots, with their separate bladders, can better maintain a consistent axial relationship between the shaft and the core if a leak develops in one of the bladders, thereby preventing the adverse consequences of a change in such axial relationship.

Such helical slots also provide an increased contact area between the shaft and the core of the roll, and thereby increased frictional torque transmission between the shaft and the core, without suffering proportionally as high a decrease in beam strength as would be required by a comparable increase in contact area using straight longitudinal slots and bladders. For reasons explained hereafter, the present invention recognizes that the pitch angle of the helical slots should preferably be no greater than about 30° measured from the longitudinal axis of the shaft, to avoid an excessive decrease in beam strength.

The helical slots also provide a radially uniform distribution of force over the core thereby minimizing deformation of the core into a non-circular shape prior to winding.

In the present invention, resilient unitary bladders, located in helical T-slots in the peripheral surface of the expansible shaft, have voids therein for the receipt of pressurized fluid, such as air, and each includes a hinge portion for allowing expansion while minimizing the loss of force due to resilient resistance to expansion of the bladder. As fluid enters the void of the bladder, the hinge portion of the bladder moves within the T-slot with very little resilient resistance until the hinge portion encounters the boundaries of the slot, thereby preventing further unwanted expansion. In a preferred embodiment, the bladder includes an integral leaf portion moveable during the expansion of the bladder for contact with the core.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
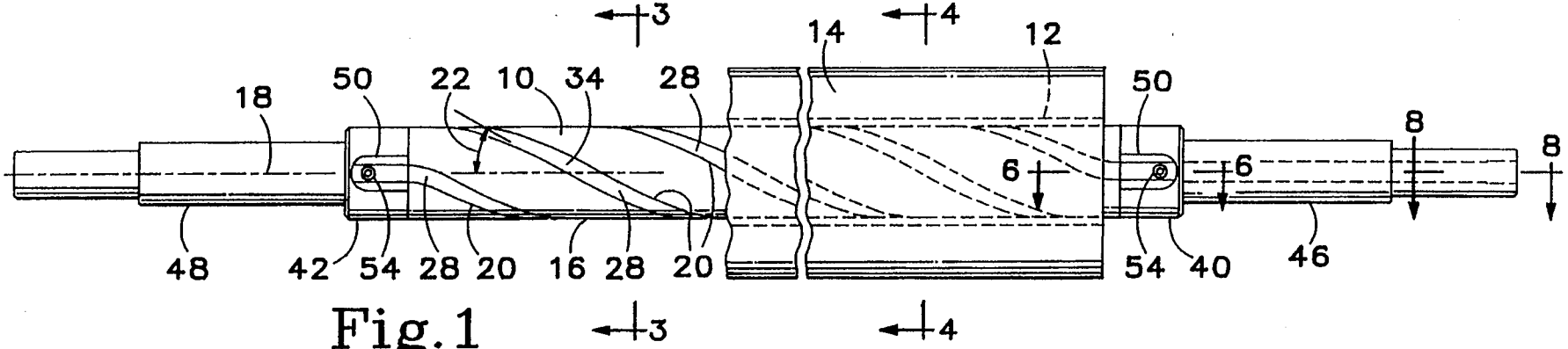
FIG. 1 is an extended side elevation view of an exemplary embodiment of an expansible shaft for a roll core embodying the present invention, shown with a partially broken-away roll.
Figure 5:
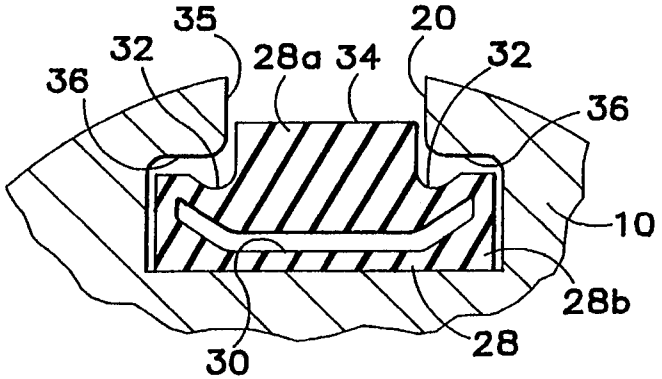
FIG. 5 is an enlarged cross-sectional view of an expandable bladder in retracted position.
Figure 3:
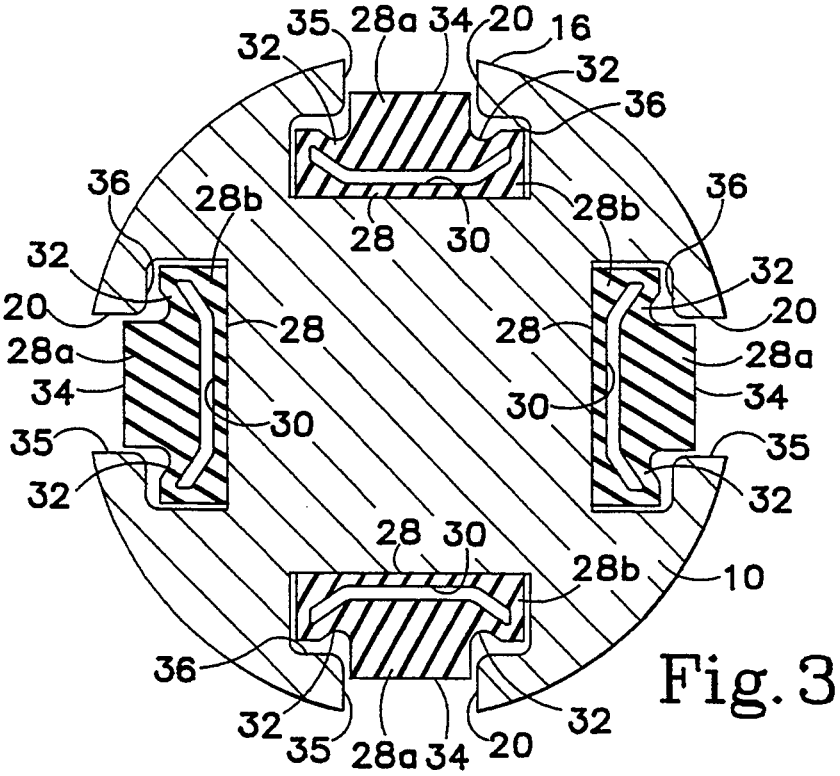
FIG. 3 is an enlarged sectional view taken along line 3—3 of FIG. 1 shown with the expandable bladders of the shaft in retracted position.
Figure 4:
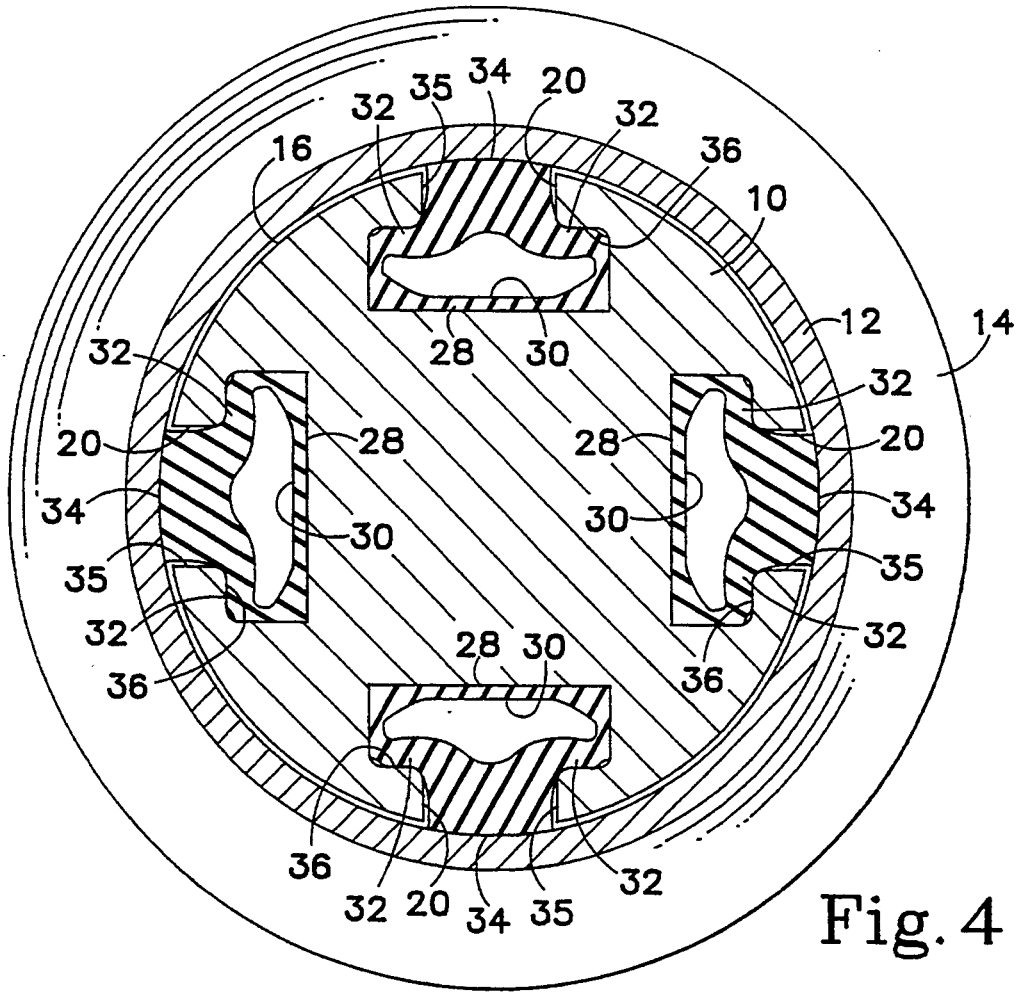
FIG. 4 is an enlarged sectional view taken along line 4—4 of FIG. 1 shown with the expandable bladders of the shaft in expanded position.

Referring now to the drawings, a preferred embodiment of an expansible shaft 10 for a core 12 of a sheet roll 14 has a longitudinally extending peripheral surface 16 and a longitudinal axis 18. Multiple separate intertwined helical slots 20 are located on the surface 16 of the shaft 10 oriented at a pitch angle 22 no greater than about 30° measured from the longitudinal axis 18. As illustrated in FIG. 1, the shaft has four such intertwined separate helical slots, but the number of slots may vary depending upon the diameter of the shaft and its intended use. The slots are symmetrically arranged about the body of the shaft. Each slot preferably is T-shaped in cross-section, as shown in FIGS. 3–5. The shaft 10, preferably of aluminum, is made by extruding the shaft with a twisting motion to form the helical T-slots. Alternatively, the shaft may be machined and constructed of other materials.

Figure 2:
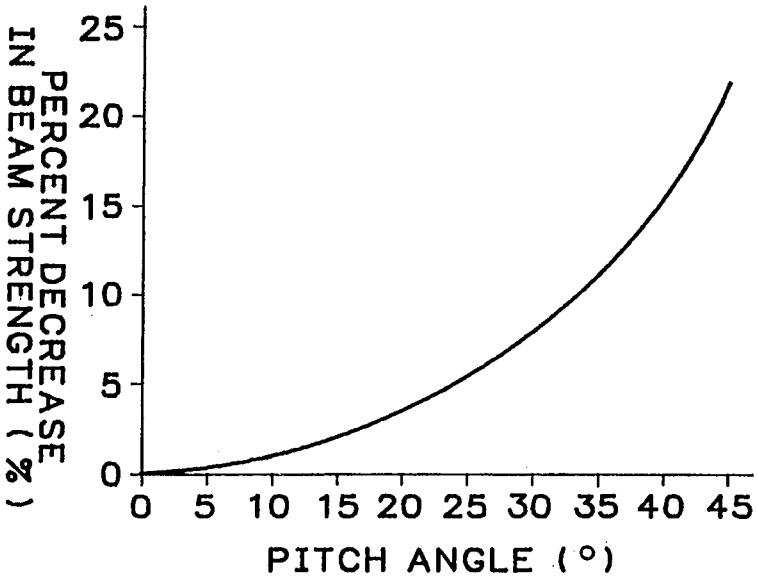
FIG. 2 is a graph showing a generalized relationship between helical slot pitch angle and shaft beam strength.

FIG. 2 graphically illustrates the relationship between shaft beam strength and helical slot pitch angle. The length of the contact area between a slot and a core increases as the pitch angle of the slot increases from 0°, the pitch angle of a linear slot. However, as shown in FIG. 2, an increase in the pitch angle also results in a decrease in the beam strength, and this relationship is not linear. The present invention recognizes that beam strength only begins to decrease dramatically for pitch angles greater than about 30°, which pitch angles should therefore preferably be avoided where beam strength is critical.

Respective separate resilient expandable elements, located in the respective helical T-slots 20, each comprise an elongate unitary bladder 28. The bladder is also T-shaped, having a narrow portion **28*a* and a wide portion 28*b* (FIGS. 3 and 5). A void 30 extends across the wide portion 28*b* beyond the sides of the narrow portion 28*a* for receiving fluid such as pressurized air for the expansion of the bladder. The bladder 28, shown unexpanded in FIGS. 3 and 5, preferably includes a contact surface or leaf 34 which is integral with the narrow portion 28*a*. The leaf 34 contacts the core 12 of the sheet roll 14 when the bladder is in an expanded state, as shown in FIG. 4. During expansion, as the void 30 receives pressurized air, hinge portions 32 of the bladder 28 pivot toward the peripheral surface 16 of the shaft and the leaf 34 moves toward the open end 35 of the T-slot 20 and approaches the core 12. The pivoting movement of the hinge portions 32 facilitates the expansion of the bladder so that little force is lost due to resilient resistance to expansion of the bladder. When the hinge portions 32 encounter the retaining surface 36 of the T-slot 20, the bladder 28** is retained in the slot.

Figure 6:
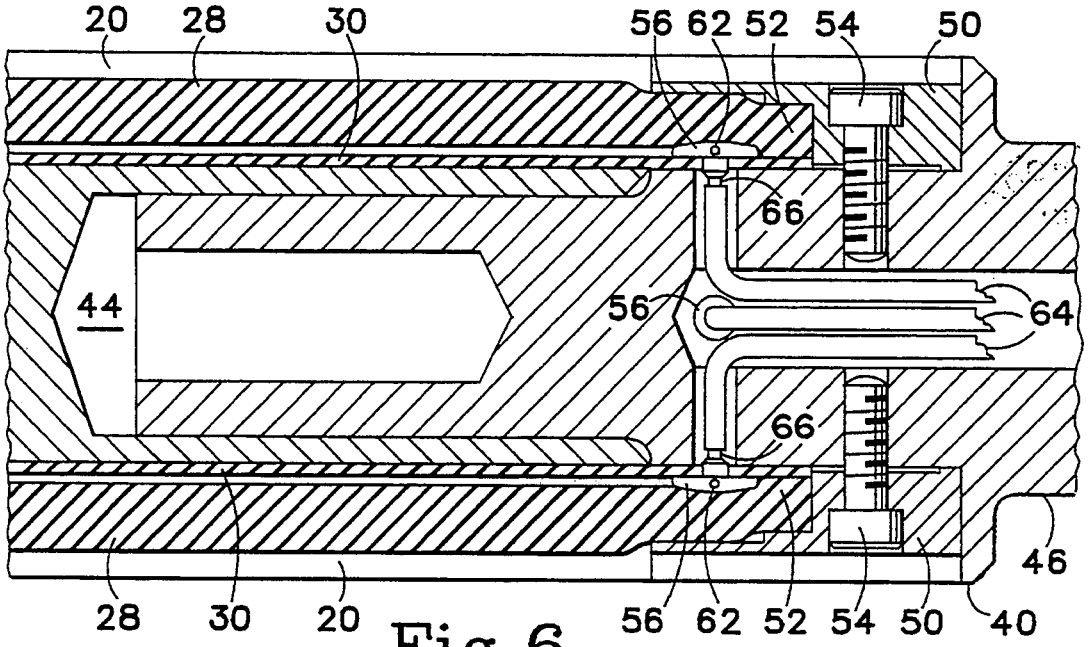
FIG. 6 is an enlarged sectional view taken along line 6—6 of FIG. 1.
Figure 7:
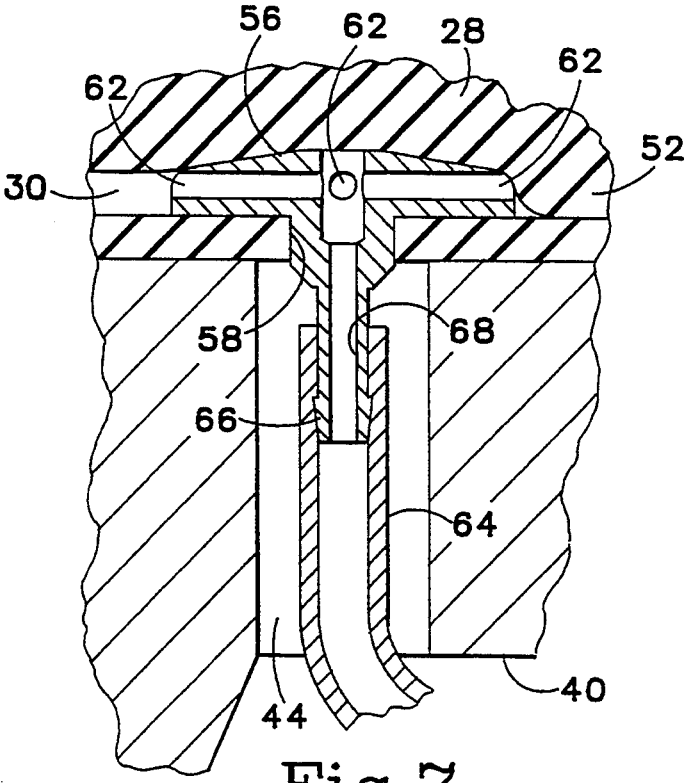
FIG. 7 is an enlarged view of a portion of FIG. 6.
Figure 8:
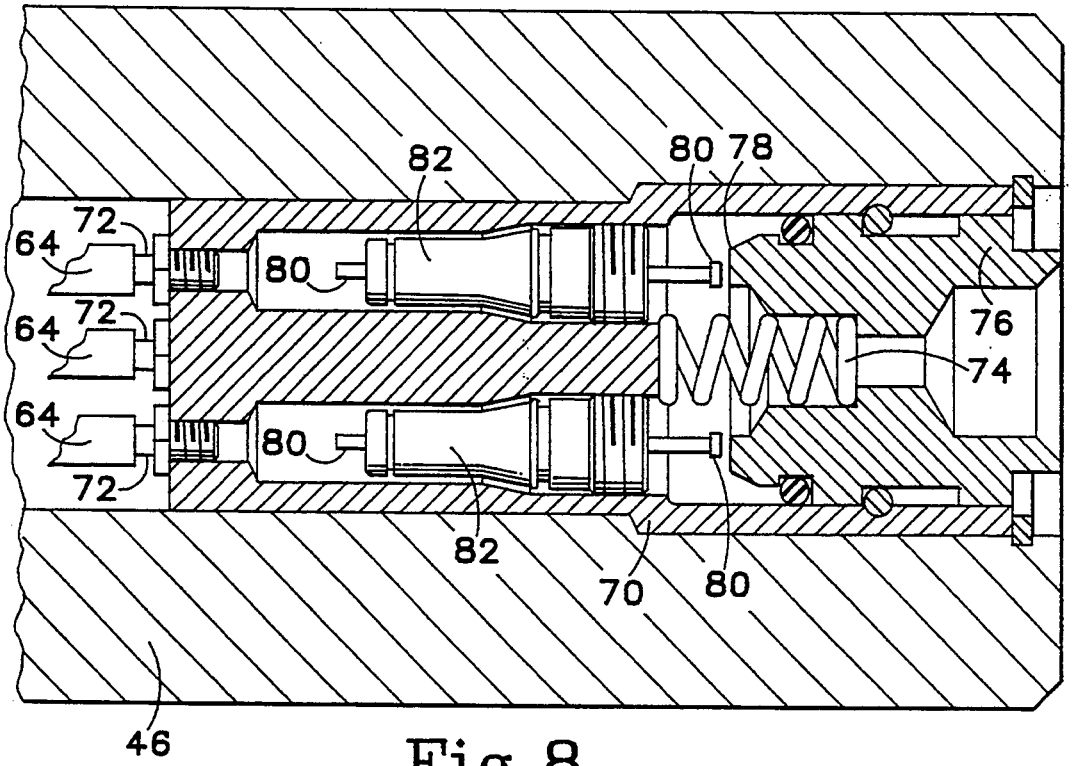
FIG. 8 is an enlarged sectional view taken along line 8—8 of FIG. 1.
Figure 9:
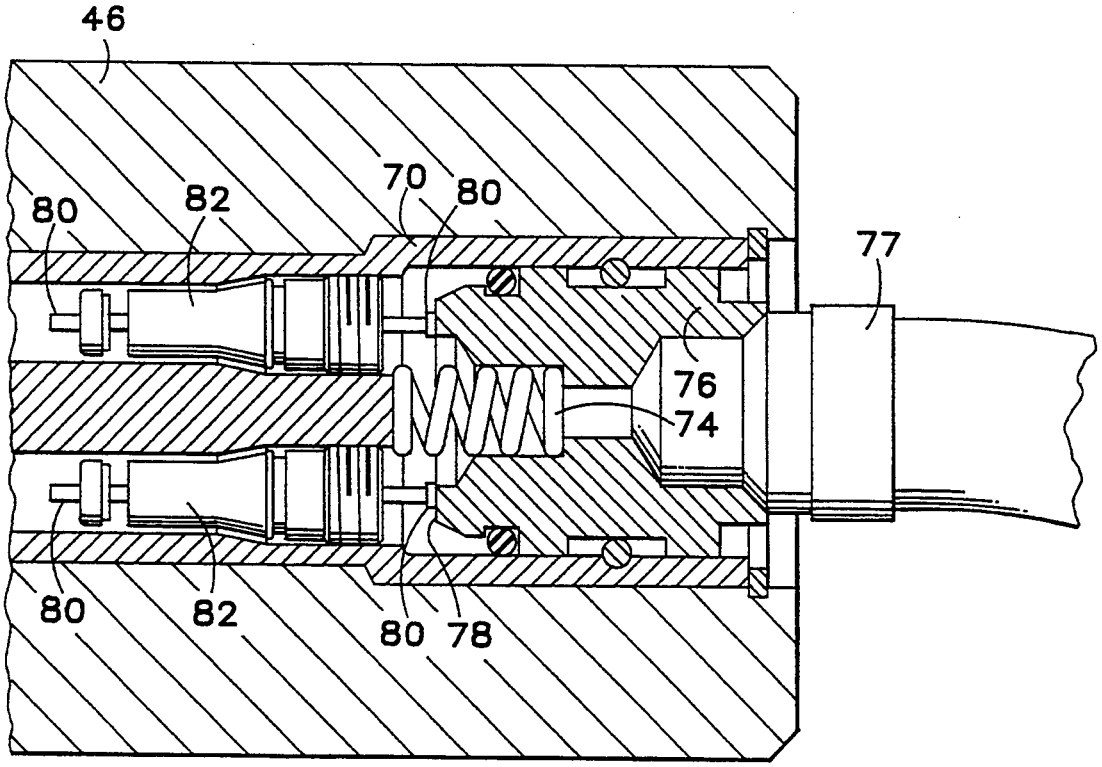
FIG. 9 is a view of the apparatus of FIG. 8 during use.

Each end 40, 42 of the shaft 10 has a bore 44 (FIG. 6) for attaching a respective journal 46, 48. An end piece 50, one for each end of each bladder, pinches closed each open end 52 of a respective bladder 28 and is held in place by screws 54. Air is introduced into each bladder through a respective mushroom head air fitting 56 (FIG. 7) which passes through an aperture 58 in the bladder proximate the end 52 of the bladder. Each mushroom head air fitting 56 has four equally spaced-apart radial air openings 62 and is connected to a respective flexible conduit 64 by means of a barbed fitting 66. Each conduit 64 passes through the journal 46 and attaches to a valve assembly 70 (FIG. 8) at a respective barbed fitting 72. A valve spring 74 biases the valve assembly 70 to the closed position as shown in FIG. 8. To open the valve assembly 70 to inflate the bladders 28, an air line 77 (FIG. 9) is pressed into a push button 76 which compresses the spring 74 and moves a valve actuation surface 78 into contact with a number of valve stems 80, opening an air channel through each core of respective conventional air inlet valves 82 similar to inflation valves used on automotive tires. Each valve 82 is in separate fluid communication with a respective different conduit 64. When the valve assembly 70 is thus in the open position, compressed air for expanding the bladders simultaneously can be introduced or, alternatively, air can be exhausted from the bladders simultaneously. However, a leak in one bladder or conduit will not affect the other bladders or conduits because of the separate inlet valves 82. When using the valve assembly 70 with a lesser number of external bladders, each extra barbed fitting 72 may be removed and replaced with a set screw (not shown).

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. An expansible shaft assembly for insertion into a core, comprising:

(a) a shaft having a longitudinally-extending peripheral surface and a longitudinal axis, said surface defining multiple longitudinally-extending separate slots;

(b) each of said slots containing a respective elongate resilient separate bladder expandable under fluid pressure to create frictional engagement with said core;

(c) the respective separate slots and bladders extending longitudinally along said shaft in a substantially helically intertwined relationship with each other, said slots and bladders being T-shaped in cross section.

2. The expansible shaft assembly of claim 1 wherein each of said slots is oriented at a pitch angle no greater than about 30° measured from said longitudinal axis.

3. The expansible shaft assembly of claim 1 wherein each bladder has a separate fluid inlet valve associated therewith for preventing the escape of pressurized fluid therefrom irrespective of the fluid pressure in another bladder.

4. The expansible shaft assembly of claim 1 wherein said shaft and slots are extruded.

5. An expansible shaft assembly for insertion into a core, comprising:

(a) a shaft having a longitudinally-extending peripheral surface and a longitudinal axis, said peripheral surface defining a substantially longitudinally oriented slot therein having a T-shaped cross section with a wide portion and a narrow portion, said narrow portion extending from said wide portion toward said peripheral surface;

(b) an elongate resilient bladder expandable under fluid pressure having a T-shaped cross section matingly inserted in said slot, the T-shaped cross section of said bladder having a wide portion and a narrow portion and including a void extending transversely through said wide portion of said bladder beyond the sides of the narrow portion of said bladder, the wide portion of said bladder having hinged bladder sections interconnected with the narrow portion of said bladder for pivoting toward the peripheral surface of said shaft and thereby extending the narrow portion of said bladder toward said peripheral surface in response to the introduction of pressurized fluid into said void.

6. The expansible shaft assembly of claim 5 wherein said narrow portion of said bladder includes an integral surface for contacting said core in response to the introduction of pressurized fluid into said void.

* * * * *

UNITED STATES PATENT AND TRADEMARK OFFICE

CERTIFICATE OF CORRECTION

PATENT NO. : 5,372,331

DATED : December 13, 1994

INVENTOR(S) : William R. Miller and Timothy J. Becker

It is certified that error appears in the above-indentified patent and that said Letters Patent is hereby corrected as shown below:

Column 2, Line 57: after expansion delete "]in" and insert -- In --

Signed and Sealed this

Twenty-first Day of March, 1995

*Attest:*

Bruce Lehman

BRUCE LEHMAN

*Attesting Officer*

*Commissioner of Patents and Trademarks*